United States Patent [19]

Suhayda

[11] 4,445,469

[45] May 1, 1984

[54] ENGINE HEATER

[76] Inventor: Louis Suhayda, 1310 Park Dr., Montgomery, Ill. 60538

[21] Appl. No.: 365,375

[22] Filed: Apr. 5, 1982

[51] Int. Cl.[3] ..... F02N 17/02

[52] U.S. Cl. ..... 123/142.5 R; 123/179 H; 432/221

[58] Field of Search ..... 126/110 B, 110 D; 432/221, 222; 165/41, 51; 123/179 H, 142.5 R, 142.5 E

[56] References Cited

U.S. PATENT DOCUMENTS

| | | | |
|---|---|---|---|
| 1,380,687 | 6/1921 | Susnich | 123/142.5 E |
| 1,460,668 | 7/1923 | Good | 123/142.5 R |
| 1,862,114 | 6/1932 | Gilly | 432/221 |
| 2,078,116 | 4/1937 | Arndt | 123/142.5 R |
| 2,295,177 | 9/1942 | King | 432/221 |
| 2,404,394 | 7/1946 | Miller | 123/142.5 R |
| 2,410,353 | 10/1946 | McCollum | 126/110 B |
| 2,414,214 | 1/1947 | Spackman | 126/110 B |
| 2,418,097 | 3/1947 | Ruff | 432/221 |
| 2,464,165 | 3/1949 | Williams | 432/221 |
| 2,851,027 | 9/1958 | Kivela | 123/142.5 E |
| 2,916,030 | 12/1959 | Hoeth | 123/142.5 E |
| 3,131,864 | 5/1964 | Young | 123/142.5 R |
| 3,233,077 | 2/1966 | Miller | 123/142.5 R |
| 3,400,700 | 9/1968 | Lindsey | 123/142.5 R |
| 3,451,663 | 6/1969 | Hille | 432/222 |
| 3,454,266 | 7/1969 | Mattingly | 432/221 |
| 3,809,527 | 5/1974 | Newman | 123/142.5 R |
| 3,870,855 | 3/1975 | Edlund | 123/142.5 E |
| 4,010,725 | 3/1977 | White | 123/142.5 R |
| 4,280,452 | 7/1981 | Kawamura | 123/179 H |

*Primary Examiner*—Daniel J. O'Connor
*Attorney, Agent, or Firm*—Neal Kalishman

[57] ABSTRACT

An engine heater for airplanes or automobiles burning propane gas to heat the engine. The heater employs electrical power to control the combustion of the propane gas and to propel the heated combustion products toward the engine. The unit may utilize a building's usual line current of 115 volts a.c.; it may also rectify this a.c. voltage to provide d.c. power capable of charging the battery on the vehicle. In the absence of the 115 V. a.c., the heater may simply connect to its own battery or the battery of the airplane or the automobile in order to warm the vehicle's engine and battery to facilitate the commencement of the vehicle's operation. The heater unit includes connections to the appropriate source of power for the heater's operation. When connecting the 115 volts a.c. source, it transforms the voltage to the appropriate magnitude to operate the heater. The unit may also include a gas pilot light, an ignition coil for the pilot light, and two electrically controlled valves. The first valve permits the passage of propane to the pilot light while the second valve allows the passage of the propane to assure the proper functioning of the unit. Without a source of electricity to assure the proper functioning of the unit, both valves close and prevent the escape of propane.

1 Claim, 2 Drawing Figures

FIG. 1
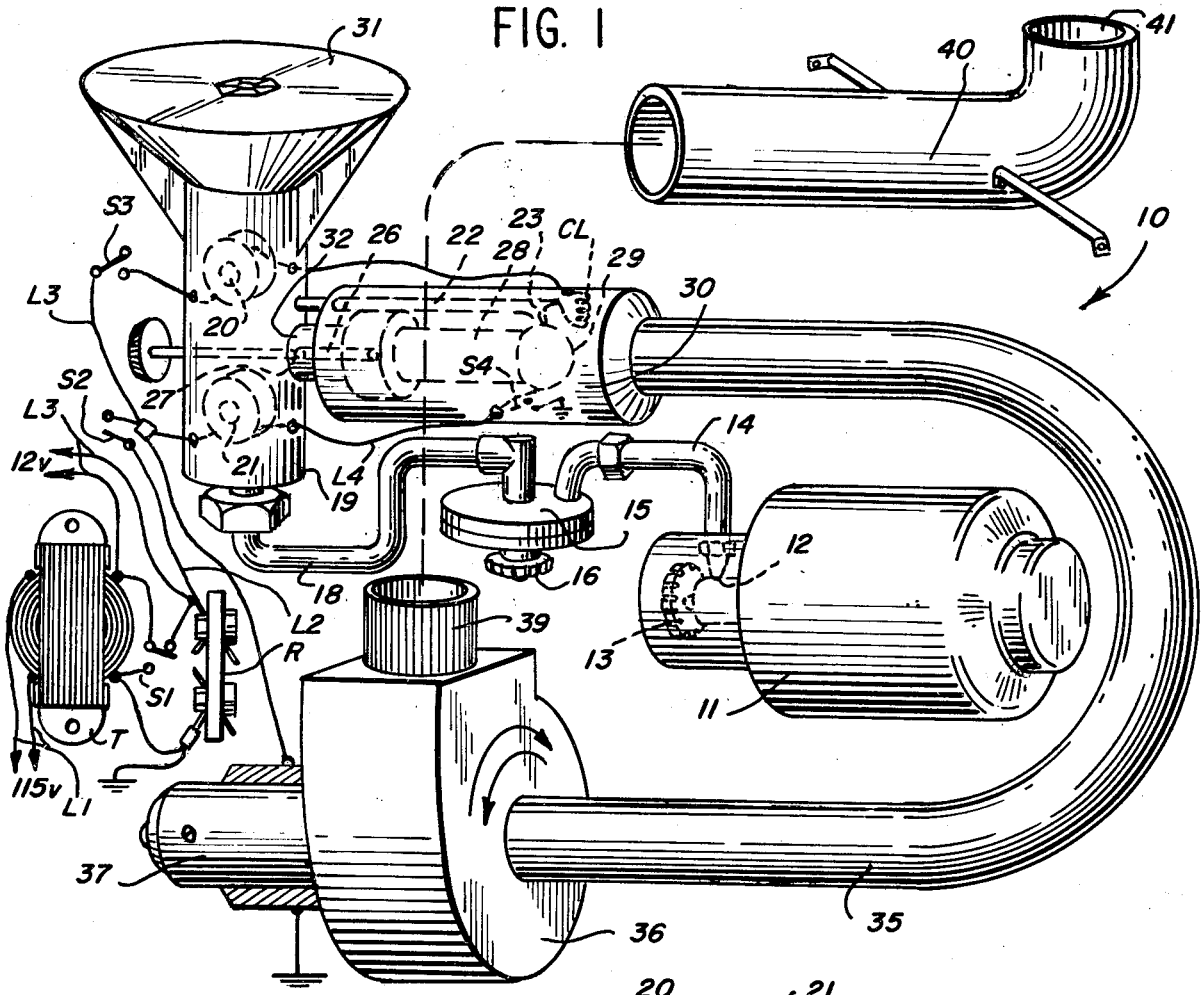
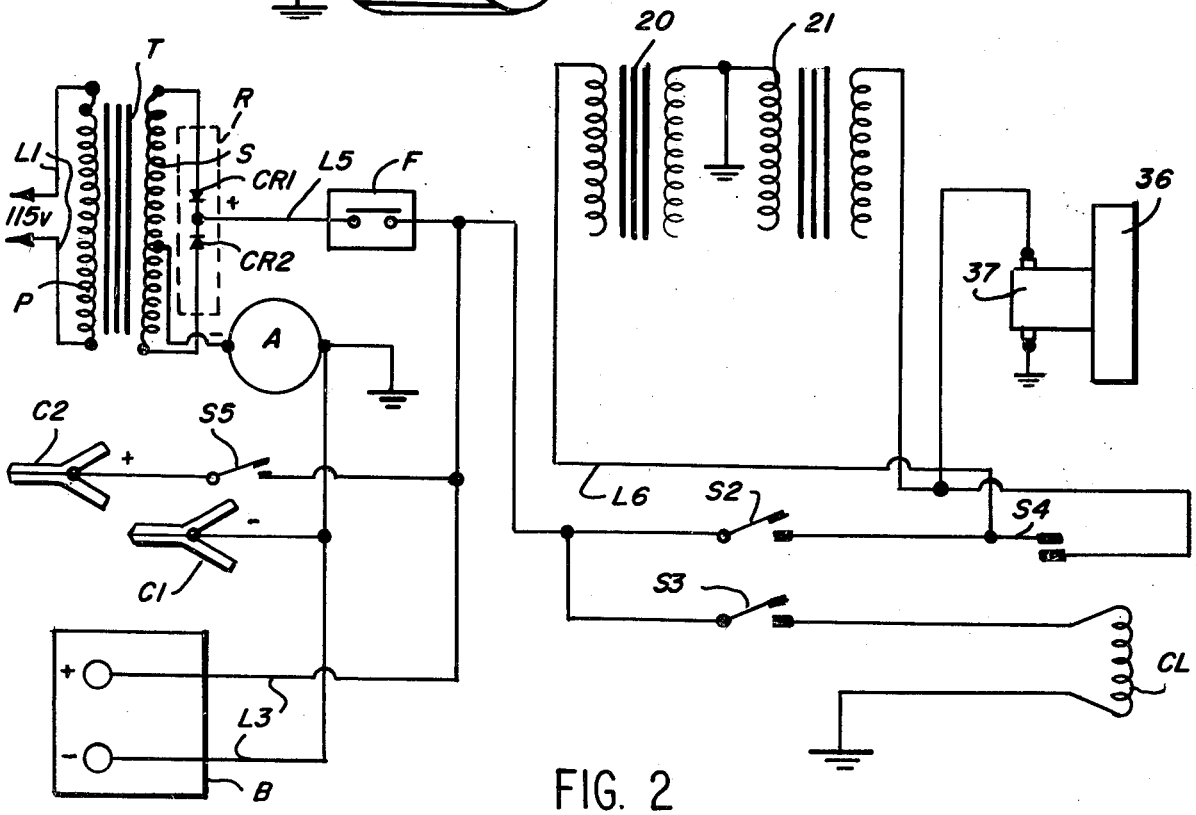
FIG. 2

ENGINE HEATER

BACKGROUND OF THE INVENTION

Extremely cold weather imposes severe difficulties upon the starting of an airplane's or automobile's engine. First, the coldness drastically increases the viscosity of the engine's lubricating oil. This includes, in particular, the oil forming a film between the parts of the engine that move relative to each other. Rather than lubricating the relative motion of these parts, the cold viscuous oil tends to act as a glue between them.

Second, the low temperatures severely limits the rate of the chemical reactions taking place in the vehicle's battery which provide its electrical energy. Consequently, even a properly charged battery can provide substantially less power than it can at warmer temperatures.

Thus, because of the cold weather, the battery provides the starter motor with less than its normal power for cranking the engine to commence the combustion processes. The cold weather further impedes this process by causing the oil to further inhibit the engine's motion.

Airplane engines, because of their critical construction, specifically require warming prior to starting should the ambient temperature fall below a predetermined level. Typically, the engine manufacturers specifically state that such warming precede attempts to start below 10° F. Automobile engines, on the other hand, do not have such specific requirements. However, at extremely cold temperatures, the difficulty incurred in starting them may prove insurmountable without such prewarming.

Various devices have found use in the warming of engines prior to their starting on cold days. U.S. Pat. Nos. 2,078,116 to E. J. Arndt, 2,418,097 to A. P. Ruff, and 3,233,077 to L. E. Miller all disclose engine heaters for airplanes. Miller in particular utilizes the electrical energy from the airplane's battery to operate his device. He inverts the d.c. current from the battery to an a.c. potential which then transforms to a potential for igniting the fuel in the heater. Miller, on the other hand, simply utilizes the usual a.c. potential at an outlet to light an electrical bulb and drive a fan to heat the motor.

U.S. Pat. Nos. 2,535,758 to O. R. Schoenrock, 3,131,864 to M. Young, 3,234,928 to L. H. Smith, 3,400,700 to S. B. Lindsey et al., and 4,010,725 to C. G. White all show engine heaters utilizing the current of a battery to control the production of the desired heat. Edlund et al., in their U.S. Pat. No. 3,870,855, show an engine heater using alternating current to both produce and control the heat required to prewarm the engine. It also rectifies a portion of this a.c. to provide a d.c. to charge the vehicle's battery.

However, each of the systems described above for prewarming engines require the availability of a particular type of electrical energy. The absence of the required source, or its presence in insufficient amounts, will preclude the engine warmer from performing its required tasks.

The device of Edlund et al. can only function when connected to the usual source of house current. However, in the absence of an outlet for such electricity, which frequently occurs around automobiles and airplanes, the device does not prepare the engine for starting. The other devices require stored energy from a battery. However, the battery may not have sufficient power to operate the warmers. In either case, the device suffers serious shortcomings that limit its utility when required.

SUMMARY

An engine heater typically includes a heating means for producing a heated gas. This heated gas then, of course, warms the engine to facilitate its starting.

The heating means can operate only when receiving a particular type of electrical voltage. This includes both the magnitude of the voltage as well as whether it displays a.c. or d.c. characteristics.

To extend its range of utility, the heater should include first and second connecting means which make connections to first and second sources, respectively, of electrical voltage. These two sources will provide electrical power of different types.

Lastly, the engine heater should have a coupler which extends between the heating and the two connectors. The coupler has two configurations and selects either the first or the second source of electrical voltage to power the heating means. In particular, when the first connector has made a connection to the first source of electrical voltage and the coupler exists in its first configuration, the engine heater will receive its appropriate voltage. The heater will also receive the appropriate voltage when the coupler exists in the second configuration and the second connector has made a connection to the seocnd source of electrical voltage.

Typically, one of the sources of electrical voltage represents the usual a.c. line voltage. The second source may then represent the usual d.c. battery. The heating means usually operates on the latter type of voltage. As a result, the coupler, when in the first configuration and receiving a.c. voltage, has a rectifier which provides a d.c. voltage. It also controls the magnitude of the voltage through a device such as a transformer or rheostat.

Of the two types of voltage sources described above, the first, or d.c. source, usually has a lesser absolute magnitude than the second, or a.c. voltage. The coupler, in this case, may then directly pass the d.c. voltage from the battery to the heater.

Since the heater operates upon a voltage comparable to the battery voltage, the coupler, when operating on a.c. voltage, may also provide a charging voltage for the engine's own battery.

Typically, the heater uses the electricity to control the ignition of a flammable fluid. The fluid usually takes the form of propane gas.

BRIEF DESCRIPTION OF THE FIGURES

FIG. 1 shows a device for prewarming engines prior to starting which can utilize either 12 V. battery current or 115 V. a.c. electrical power.

FIG. 2 gives a circuit diagram for the electrical components of FIG. 1.

DETAILED DESCRIPTION

FIG. 1 illustrates an engine heater generally at 10. To provide a heated gas, the tank 11 contains a flammable fluid. Propane gas under pressure represents a suitable choice for that fluid.

The tank 11 includes the valve 12 and the valve handle 13 which controls the passage of the fluid through the conduit 14 to the regulator 15. The regulator 15, in turn, controls the amount of fuel provided to the burner section of the heater 10. The knob 16 of the regulator 15 remains under the manual control of the heater's operator.

The gas passing through the regulator 15 then flows through the conduit 18 and then enters the manifold 19 where it comes under the control of the pilot valve 20 and the main valve 21. The gas passing through the pilot valve 20 flows through the tube 22 until it reaches the opening 23. The gas exiting through the opening 23 provides a pilot light for the ignition of the main stream of gas. That main stream passes through the valve 21 and into the conduit 26. The flame adjuster 27 controls the amount of gas passing into the conduit 26 and, thus, the magnitude of the main flame. The gas from the conduit 26 then passes through the tube 28 until it reaches the main opening 29. There it ignites under the influence of the pilot light provided at the opening 23 of the tube 22.

Ignition of the gas exiting the tube 28 at the opening 29 takes place in the burner tube 30. The oxygen for the burning gases in the burner tube 30 passes through the filter 31 through the conduit 32 which surrounds the gas conduit 26.

Ignited, heated gases from the burner tube 30 then pass through the tube 35 till it reaches the blower 36. The motor 37 provides the power for the blower 36 to move the heated gases out through its opening 39 and into the extension tube 40. The proper placement of the extension tube 40 allows the heated gases passing through the opening 41 to reach the proper location in the aircraft or automobile engine.

As an alternative arrangement, the blower 36 could force cool air through the filter 31 and thus into the ignition tube 30. This configuration would keep the hot gases from contacting the blower 36 itself. Since it would only receive cold air, the blower could have a composition of a plastic, for example, which could not withstand the high temperatures of the heated gases.

To control its operation, the heater 10 may receive 115 volt a.c. power along the leads L1 which passes through the transformer T and the rectifier R. The combination of the transformer T and the rectifier R will provide electrical power of approximately 12 V. between ground and the lead L2. This would also provide 12 V. along the leads L3. To make use of the 115 V. in this fashion, the selector switch S1 should remain in the configuration shown in the figure. Alternately, without the 115 V. a.c. power, moving the switch S1 to the second position allows the use of a 12 V. battery connected to the leads L3. Again, this would provide 12 V. between ground and the lead L2.

After appropriately positioning the switch S1 and connecting to the proper source of electrical power, the actual operation of the circuit commences by closing the main power switch S2. This provides power to the motor 37 which drives the blower 36. It also allows current to flow along the lead L3 to the ignition switch S3. Closing the switch S3 provides current to the ignition valve 20 to open it and allow propane to flow through it and along the conduit 22 to its opening 23. The switch S3 also provides current to the ignition coil CL. The ignition coil CL takes the form of a resistive element heating to a sufficient temperature to ignite the pilot light gas at the opening 23.

Lastly, the switch S2 also allows current to flow through the main valve 21. However, to complete the circuit, the current flowing from the main valve 21 must pass through the thermal switch S4. The termal switch S4 opens when the temperature in the burner tube 30 has reached a predetermined level. Below that temperature, the switch S4 remains closed and allows current to flow through the main valve 21 so that the propane may pass through the conduit 28 and into the burner tube 30 to produce the desired heat. Upon reaching the desired temperature, the thermal switch S4 opens, which closes the main valve 21. This stops propane from entering the burner tube 30 until the temperature inside falls below the predetermined level. At that point, the switch S4 again closes, the main valve 21 opens, and more propane enters the burner tube 30 to produce further heat.

The diagram in FIG. 2 provides a somewhat different circuit from that shown in FIG. 1, although both will effectively control the heater 10. In FIG. 2, the transformer T may receive 115 V. a.c. power from the leads L1 which couple to the transformer's primary winding P. The middle tap of the secondary winding S of the transformer T couples across the ammeter A to ground. The ammeter A measures the total current derived by the system from the a.c. source.

The ends of the secondary winding S connect across the diodes CR1 and CR2 to the lead L5. Taken together, the diodes CR1 and CR2 constitute the full-wave rectifier R. The current from the lead L5 passes through the fuse F which protects the remainder of the circuit.

The power provided by the transformer T may also help charge the battery in the aircraft or automobile involved. The alligator clip C1 connects to ground as shown. The other alligator clip C2 connects to the positive voltage output of the transformer T after the fuse F. Coupling the alligator clips C1 and C2 to the negative and positive terminals of the vehicle's battery, respectively, and closing the switch S5 imposes the potential difference developed by the transformer T and rectified by rectifier R across the vehicle's battery to charge it. The combined effect of heating the engine and charging the vehicle's battery may prove particularly necessary on an extremely cold day.

FIG. 2 also shows that the heater may utilize the engergy of the 12 V. battery B. This battery B may actually constitute part of the heater unit 10 itself. Alternately, it may take the form of the battery on the engine undergoing heating. In this case, rather than having separate connections, the alligator clips C1 and C2 may again provide the appropriate connections to the battery.

Rather than using the switch S1 in FIG. 1, the choice in FIG. 2 between the a.c. power from the transformer T and the d.c. power from the battery B depends upon the connections of the leads L1 and L3. Connecting the leads L1 to the usual outlet provides a.c. power to the circuit. Connecting the leads L3 to a battery provides the circuit with d.c. power.

Closing the main power switch S2 allows power to flow along the lead L6 to the pilot light valve 20. This current opens the pilot valve 20 and allows the gas to flow to the pilot light. To initially light the pilot light, the operator closes the ignition switch S3 to provide current to heat the coil CL. This initially ignites the pilot light, after which the switch S3 may open since the pilot light will then usually sustain itself without further current in the coil CL. Closing the main power switch S2 also provides current to the motor 37 which drives the blower 36.

Lastly, the closure of the main switch also permits current to flow to the termal switch S4. When the temperature in the burner tube remains below the present level, the switch S4 closes and current flows to the main valve 21 to allow the propane to enter the burner. When the temperature in the burner tube exceeds the predetermined level, the thermal switch S4 opens, and the valve 21 closes. The valve 21 will remain closed until the temperature in the burner falls below the present level. This will then effectuate the subsequent closing of the thermal switch S4 to provide further gas to the burner.

The heater is a separate unit from the vehicle and works independently of the vehicle. The extension tube 40 is moveable and is usually placed beneath the automobile and directly under the engine compartment. Heated gases pass out of the opening 41 in order to heat the engine.

Accordingly, what is claimed is:

1. An engine heater comprising:

A. heating means for producing a heated gas, said heating means being operable only on d.c.;

B. first connecting means, for making a connection to a first source of voltage which provides a d.c. electrical voltage not exceeding about 20 V.;

C. second connection means for making a connection to second source of a.c. electrical voltage;

D. coupling means, couple between (1) said heating means and (2) said first and second connecting means and having first and second configurations for providing electrical voltage at said particular time to set heating means (a) when said first configuration and when said first connecting means has made a connection to said first source of electrical voltage and (b) when said second configuration and when said second connecting means has made a connection to said second source of electrical voltage;

E. said first source of electrical voltage having a lesser absolute magnitude than said second source of electrical voltage and said coupling means, when in said first configuration, directly passing the electrical voltage from said first source to said heating means;

F. Said coupling means including rectifying means coupled, when said coupling means is in said second position, between said second connecting means and said heating means;

G. Said second source providing an a.c. electrical voltage having a magnitude greater than about 100 volts;

H. An internal battery capable of storing a voltage equal in magnitude to said first source of electrical voltage and said coupling means, when in said first position, providing the voltage from said internal battery to said heating means;

I. Charging means, coupled to said rectifying means for providing a d.c. voltage about equal to said electrical voltage of said first source, when said coupling means is in said second setting, to both said internal battery and to said first connecting means;

J. A pilot light operable upon a flammable fluid and an ignition coil operable on said particular type of voltage for selectively igniting said pilot light;

K. Igniting means for causing the ignition of a flammable fluid and fan means for moving the combustion products of the ignition of said flammable fluid to a desired location; and L. A first valve means, operable upon said electrical voltage of said particular type, for selectively permitting and prohibiting the passage of said flammable fluid to said pilot light and second valve means, operable upon said electrical voltage of said particular type, for selectively permitting and prohibiting the passage of said flammable fluid to said igniting means.

* * * * *